US010208914B2

(12) United States Patent
Shimoda

(10) Patent No.: US 10,208,914 B2
(45) Date of Patent: Feb. 19, 2019

(54) REFLECTOR WITH CONCENTRIC INTERRUPTED REFLECTING SURFACES

(71) Applicant: Whelen Engineering Company, Inc., Chester, CT (US)

(72) Inventor: Kyle Shimoda, Middletown, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 232 days.

(21) Appl. No.: 14/848,864

(22) Filed: Sep. 9, 2015

(65) Prior Publication Data

US 2017/0067616 A1 Mar. 9, 2017

(51) Int. Cl.

| | |
|---|---|
| ***F21V 7/00*** | (2006.01) |
| ***F21V 7/06*** | (2006.01) |
| ***F21S 43/14*** | (2018.01) |
| ***F21S 43/31*** | (2018.01) |

(52) U.S. Cl.

CPC ..... *F21S 43/31* (2018.01); *F21S 43/14* (2018.01); *F21V 7/0025* (2013.01); *F21V 7/06* (2013.01)

(58) Field of Classification Search

CPC ..... F21S 48/234; F21S 48/215; F21S 43/31; F21S 43/14; F21V 7/0025; F21V 7/06

See application file for complete search history.

(56) References Cited

U.S. PATENT DOCUMENTS

| | | | |
|---|---|---|---|
| 1,235,275 | A | 7/1917 | Wood |
| 2,282,167 | A | 5/1942 | Cullman |
| 3,774,023 | A | 11/1973 | Cobarg et al. |
| 5,103,381 | A | 4/1992 | Uke |
| 6,471,375 | B2 | 10/2002 | Kobayashi et al. |
| 6,641,284 | B2 | 11/2003 | Stopa et al. |
| 6,644,841 | B2 | 11/2003 | Martineau |
| 6,739,738 | B1 | 5/2004 | Smith |
| 6,758,582 | B1 | 7/2004 | Hsiao et al. |
| 6,851,835 | B2 | 2/2005 | Smith et al. |
| 6,940,660 | B2 | 9/2005 | Blumel |
| 6,986,593 | B2 | 1/2006 | Rhoads et al. |
| 7,001,047 | B2 | 2/2006 | Holder et al. |
| 7,008,079 | B2 | 3/2006 | Smith |
| 7,070,310 | B2 | 7/2006 | Pond |
| 7,079,041 | B2 | 7/2006 | Fredericks et al. |

(Continued)

FOREIGN PATENT DOCUMENTS

WO 2002014738 A1 2/2002

OTHER PUBLICATIONS

"Standard Plastic Lenses for Semiconductors," Ledil Oy, Tehdaskatu 13, 24100 Salo, Finland, Examples of Products, 14 pages (Aug. 3, 2005).

(Continued)

*Primary Examiner* — William N Harris

(74) *Attorney, Agent, or Firm* — Alix, Yale & Ristas, LLP

(57) ABSTRACT

A compact optical assembly includes a linear array of LEDs and a plurality of reflectors. The reflectors include two concentric reflecting surfaces that surround the LED light sources. The inner reflecting surface reflects the majority of the light emitted from the LED light source and the outer reflecting surface reflects light emitted through longitudinal channels in the inner reflecting surface. The concentric reflecting surfaces cooperate to create a wide-angle beam of light with a desired dispersion pattern.

15 Claims, 8 Drawing Sheets

(56) References Cited

U.S. PATENT DOCUMENTS

| | | | | |
|---|---|---|---|---|
| 7,083,304 | B2 | 8/2006 | Rhoads et al. | |
| 7,083,313 | B2 | 8/2006 | Smith | |
| 7,114,832 | B2 | 10/2006 | Holder et al. | |
| 7,118,261 | B2 | 10/2006 | Fredericks et al. | |
| 7,158,019 | B2 | 1/2007 | Smith | |
| 7,172,319 | B2 | 2/2007 | Holder et al. | |
| 7,175,303 | B2 | 2/2007 | Kovacik et al. | |
| 7,246,917 | B2 | 7/2007 | Rhoads et al. | |
| 7,427,167 | B2 | 9/2008 | Holder et al. | |
| 7,438,447 | B2 | 10/2008 | Holder et al. | |
| 7,461,944 | B2 | 12/2008 | Alessio | |
| 7,520,650 | B2 | 4/2009 | Smith | |
| 7,674,018 | B2 | 3/2010 | Holder et al. | |
| 7,690,826 | B2 | 4/2010 | Kim | |
| 7,712,931 | B1 | 5/2010 | Smith | |
| 7,850,334 | B2 | 12/2010 | Holder et al. | |
| 7,850,345 | B2 | 12/2010 | Holder et al. | |
| 7,959,322 | B2 | 6/2011 | Smith | |
| 7,993,036 | B2 | 8/2011 | Holder et al. | |
| 8,162,504 | B2 * | 4/2012 | Zhang | F21V 7/005 362/217.02 |
| 8,246,212 | B2 | 8/2012 | Schaefer et al. | |
| 8,247,957 | B2 | 8/2012 | Chen et al. | |
| 2002/0172046 | A1 * | 11/2002 | Perlo | F21V 7/0016 362/304 |
| 2003/0156416 | A1 * | 8/2003 | Stopa | F21V 29/70 362/294 |
| 2007/0242461 | A1 | 10/2007 | Reisenauer et al. | |
| 2008/0165535 | A1 | 7/2008 | Mazzochette | |
| 2008/0205061 | A1 | 8/2008 | Holder et al. | |
| 2008/0259631 | A1 | 10/2008 | Holder et al. | |
| 2009/0016052 | A1 | 1/2009 | Holder et al. | |
| 2009/0021945 | A1 | 1/2009 | Holder et al. | |
| 2009/0043544 | A1 | 2/2009 | Holder et al. | |
| 2009/0135606 | A1 * | 5/2009 | Young | F21V 7/0025 362/310 |
| 2009/0168395 | A1 | 7/2009 | Mrakovich et al. | |
| 2010/0110677 | A1 | 5/2010 | Stein | |
| 2010/0128489 | A1 | 5/2010 | Holder et al. | |
| 2010/0134046 | A1 | 6/2010 | Holder et al. | |
| 2010/0172135 | A1 | 7/2010 | Holder et al. | |
| 2010/0238669 | A1 | 9/2010 | Holder et al. | |
| 2012/0049748 | A1 | 3/2012 | Stuesse et al. | |
| 2012/0327655 | A1 | 12/2012 | Li | |
| 2013/0235580 | A1 | 9/2013 | Smith | |
| 2013/0279159 | A1 | 10/2013 | Pickard et al. | |
| 2013/0306998 | A1 | 11/2013 | Ulasyuk | |
| 2014/0313739 | A1 * | 10/2014 | Yriberri | F21V 7/0025 362/299 |
| 2017/0256693 | A1 * | 9/2017 | Yoshizawa | H01L 33/60 |

OTHER PUBLICATIONS

"OEM Module Guide," Dialight Lumidrives Ltd., 7 pages (2006).
"L2Optics Flare Lens," L2Optics Ltd., sales brochure, 2 pages (2005).

* cited by examiner

REFLECTOR WITH CONCENTRIC INTERRUPTED REFLECTING SURFACES

BACKGROUND

This disclosure relates generally to LED light sources, and more particularly, to a reflector for use with an LED lamp.

It is traditional to arrange lights on a vehicle to perform a variety of functions, including fog lighting, warning lighting, spot lighting, takedown lighting, scene lighting, ground lighting, and alley lighting. Emergency vehicles such as police, fire, rescue and ambulance vehicles typically include lights intended to serve several of these functions. Generally speaking, larger lights are less useful than smaller lights because of limited mounting space on the vehicles, as well as aerodynamic and aesthetic considerations. The trend is toward very bright, compact lights which use LEDs for a light source.

Prior art optical configurations may not provide acceptable performance when the size of the light is reduced. These smaller configurations make it particularly difficult to provide focused beams of light of a desired intensity. Traditional optical configurations are limited by symmetrical surfaces of rotation that require a larger optical assembly than desired due to the required reflecting surfaces.

DETAILED DESCRIPTION

Figure 1:
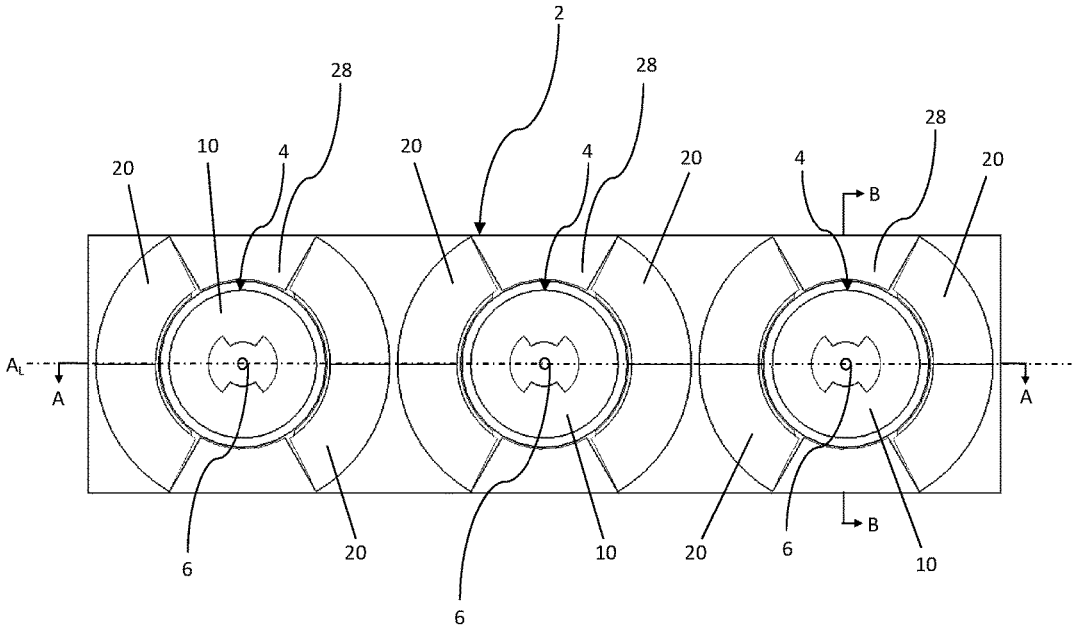
FIG. 1 is a top plan view of one embodiment of an optical assembly according to aspects of the disclosure.

Referring to FIG. 1, one embodiment of the optical assembly 2 comprises a plurality of reflectors 4 arranged along line A-A. LED light sources 6 are generally disposed in the center of the reflectors 4. Reflectors 4 redirect a portion of the light emitted from the LED light sources 6 into a desired illumination pattern. For clarity purposes, the longitudinal direction is defined as along line A-A and the lateral direction is defined as along line B-B. Longitudinal axis $A_L$ is defined on plane one $P_1$ along line A-A.

Figure 2:
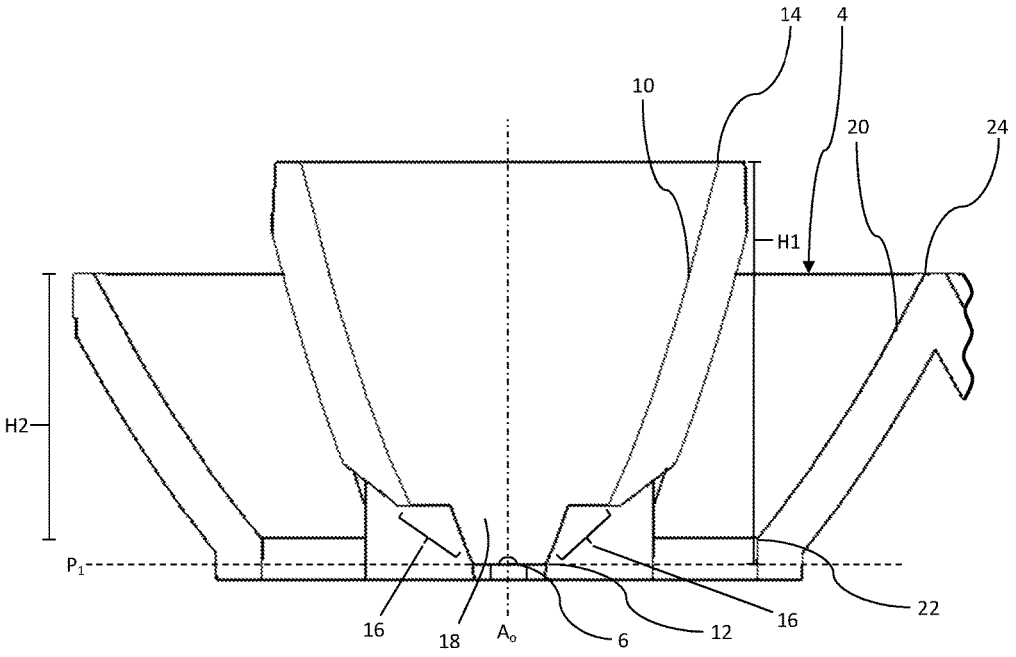
FIG. 2 is a partial side sectional view of the optical assembly of FIG. 1 taken along line A-A thereof.

Referring to FIG. 2, LED light source 6 emits light in a hemispherical emission pattern to one side of first plane $P_1$, surrounding optical axis $A_o$. Optical axis $A_o$ is perpendicular to the first plane $P_1$. The reflector 4 comprises two concentric reflecting surfaces that are generally surfaces of rotation about the optical axis $A_o$.

In the depicted embodiment, the reflector 4 has an inner reflecting surface 10 and an outer reflecting surface 20. The inner reflecting surface 10 extends from an inner end 12 at first plane $P_1$ to an outer end 14. The outer reflecting surface 20 extends from a first end 22 to a second end 24. In the depicted embodiment, plane one $P_1$ is axially closer to the second end 24 than the outer end 14. The axial height of inner reflecting surface 10 is defined as H1 and the axial height of outer reflecting surface 20 is defined as H2. In the depicted embodiment, the ratio of H1 to H2 is approximately 1.5. This ratio may differ depending on the desired light emission for the particular application.

Figure 3:
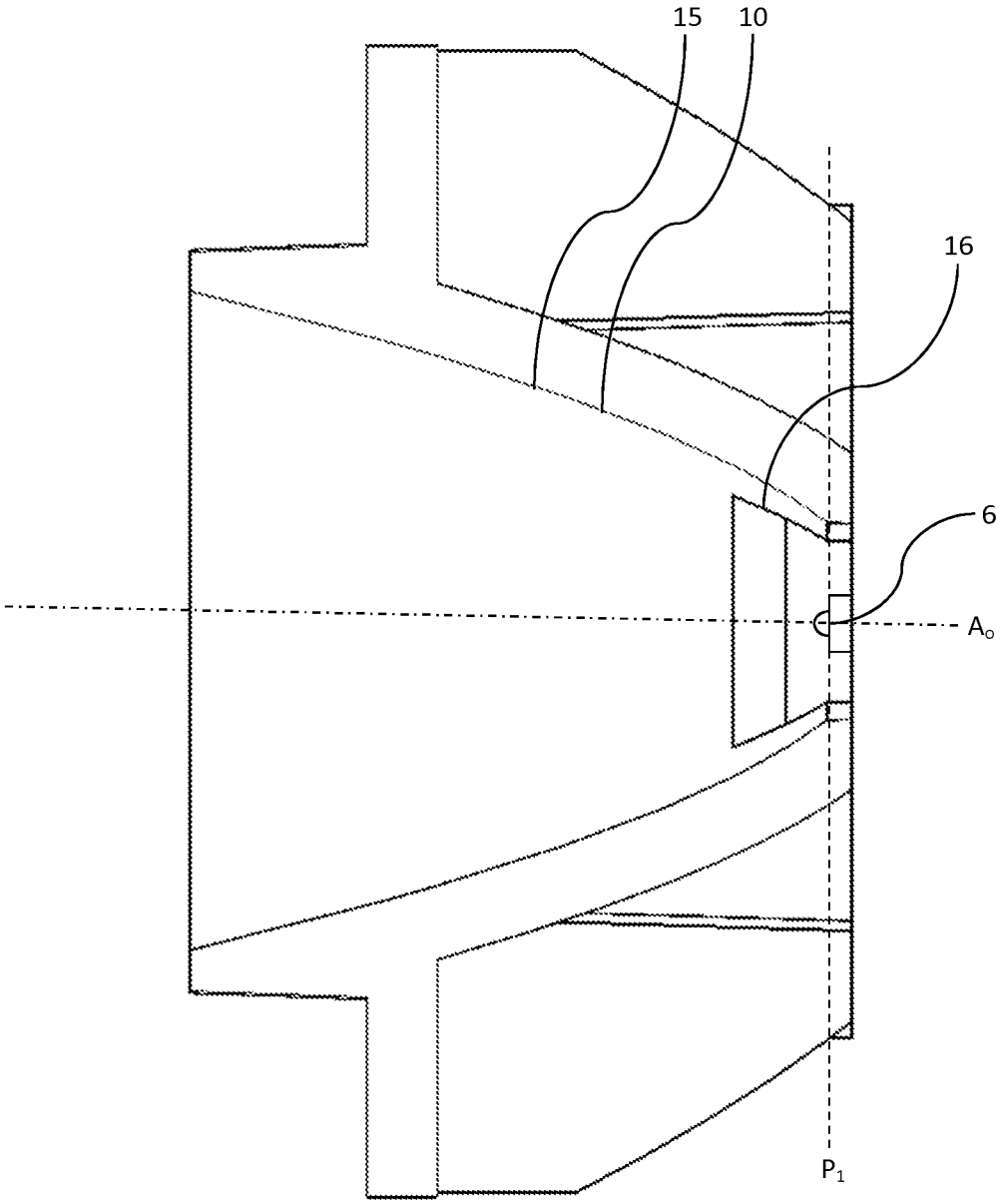
FIG. 3 is a side sectional view of the optical assembly of FIG. 1 taken along line B-B thereof.

Referring to FIG. 3, the inner reflecting surface 10 is defined by a curve 15 of a parabola having a focus at LED light source 6 rotated about optical axis $A_o$. The inner reflecting surface 10 has two windows 16 disposed generally opposite one another in about longitudinal axis $A_L$. In other embodiments, the curve 15 is aspheric and arcuate but not a portion of a parabola.

Referring to FIG. 2, the windows 16 allow light to reflect on the outer reflecting surface 20. Between windows 16 are lateral tabs 18 that reflect light emitted in the lateral direction. Light rays emitted from the LED light source in the lateral direction reflect on the tabs 18 of inner reflecting surface 10. This creates a wide-angle beam of light that is focused about the longitudinal axis $A_L$.

The outer reflecting surface 20 is defined by a curve 25 of a parabola having a focus at LED light source 6 between a first end 22 and a second end 24 generally rotated about the optical axis $A_o$. The first end 22 is defined axially by a light ray 26 that originates at the LED light source and passes through the longitudinal slot 16 of the inner reflecting surface 10 at plane one $P_1$. In other embodiments, the curve 25 is aspheric and arcuate but not a portion of a parabola.

Figure 4:
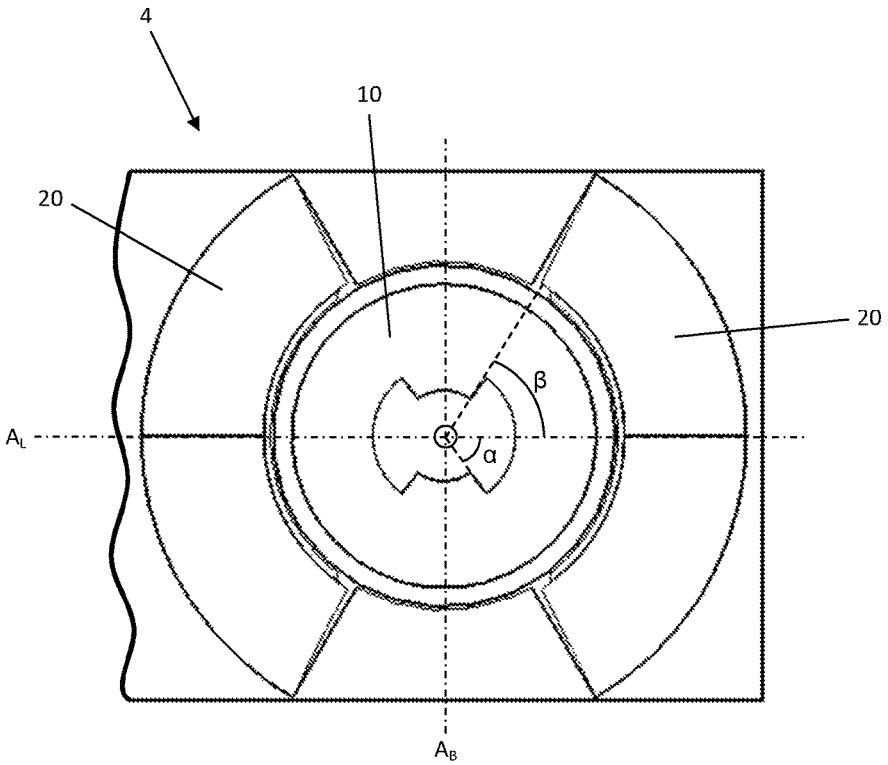
FIG. 4 is an enlarged partial top plan view of the optical assembly of FIG. 1.
Figure 5:
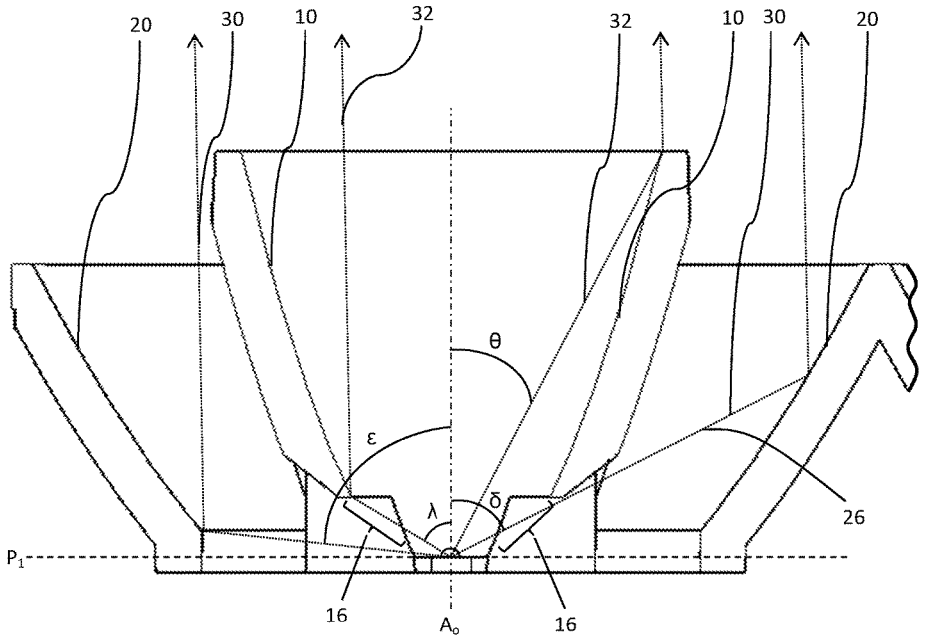
FIG. 5 is a partial side sectional view of the optical assembly of FIG. 1 taken along line B-B thereof, depicting light ray tracing.

Light emitted from the LED light source 6 may be characterized as either "wide angle" light 30 or "narrow angle" light 32. The longitudinal direction is defined as within a trajectory of $\alpha$ degrees from longitudinal axis $A_L$. In the embodiment depicted in FIG. 4 $\alpha$ is approximately 55 degrees, and may range from 30 to 80 degrees. FIG. 5 depicts the "wide angle" and "narrow angle" light in greater detail. "Wide angle" light 30 is defined as light that is reflected by the outer reflecting surface 20 when directed in the longitudinal direction. "Wide angle" light 30 has a trajectory greater than approximately $\delta$ degrees from optical axis $A_o$. In the depicted embodiment $\delta$ is approximately 63 degrees, and may range from 55 to 75 degrees. "Narrow angle" light 32 is defined as light that is reflected by the inner reflecting surface 10 when directed in the longitudinal direction. "Narrow angle" light 32 has a trajectory less than approximately $\Lambda$ degrees from optical axis $A_o$. In the depicted embodiment, $\lambda$ is approximately 57 degrees, and may range from 45 to 65 degrees.

Some "narrow angle" light is emitted from the optical assembly without being handled by either the inner or outer reflecting surfaces. "Narrow angle" light that has a trajectory less than $\theta$ degrees from the optical axis $A_o$, is not handled by either reflecting surface. In the depicted embodiment, $\theta$ is approximately 27 degrees, and may range from 10 to 40 degrees. The light that exits the center of the optical assembly without being handled by the inner reflecting surface is generally already traveling substantially in the desired direction. Although this light is divergent from the optical axis $A_o$, the angle $\theta$ is chosen depending on the specific application.

Some "wide angle" light emitted in the longitudinal direction is not handled by the outer reflecting surface. "Wide angle" light emitted in the longitudinal direction that has a trajectory greater than $\varepsilon$ degrees from the optical axis $A_o$ is not handled by the outer reflecting surface. In the depicted embodiment, ε is approximately 83 degrees. Very little light is emitted from LED light sources in the horizontal direction (ε equal to 90 degrees). The value of angle c is chosen depending on the specific LED light source and needs of the light dispersion pattern. Angle ε may range from 70 to 90 degrees.

In one embodiment, the outer reflecting surface 20 is interrupted, in the lateral direction, by support members 28. Referring to FIG. 4, the support members 28 are defined by angle β relative to longitudinal axis $A_L$. In the depicted embodiment, angle β is approximately 60 degrees, and may range from 40 to 80 degrees. The support members 28 allow for a narrower reflector 4 in the lateral direction that nevertheless reflects LED light sources 6 in the desired pattern and intensity.

Figure 6:
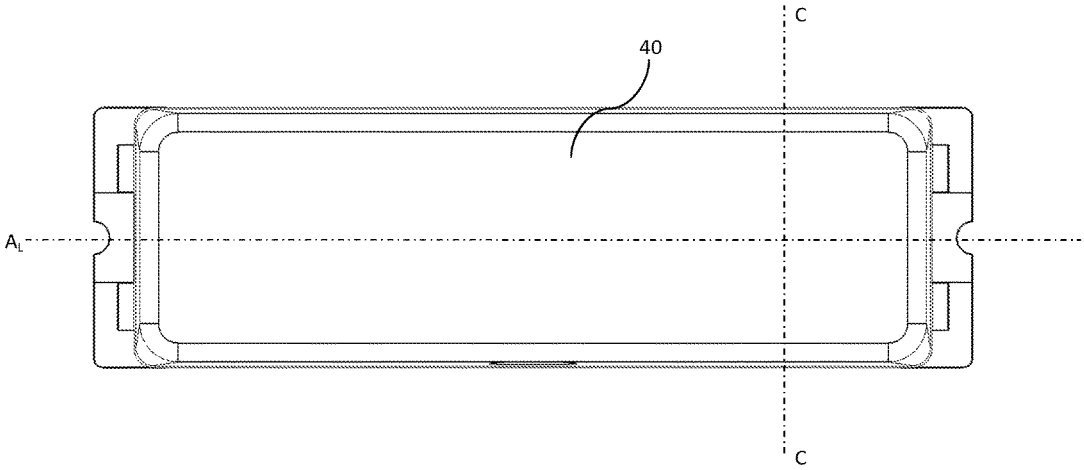
FIG. 6 is a top plan view of the optical assembly of FIG. 1 including one embodiment of a lens according to aspects of the disclosure.
Figure 7:
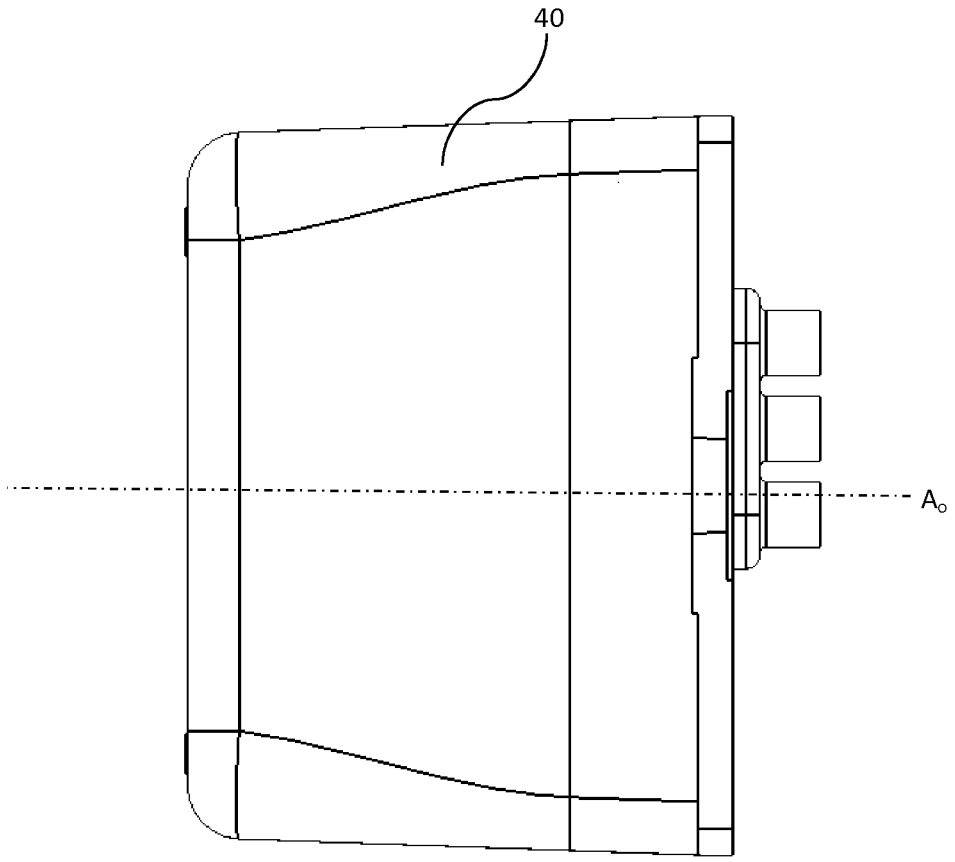
FIG. 7 is a side plan view of the lens of FIG. 6.
Figure 8:
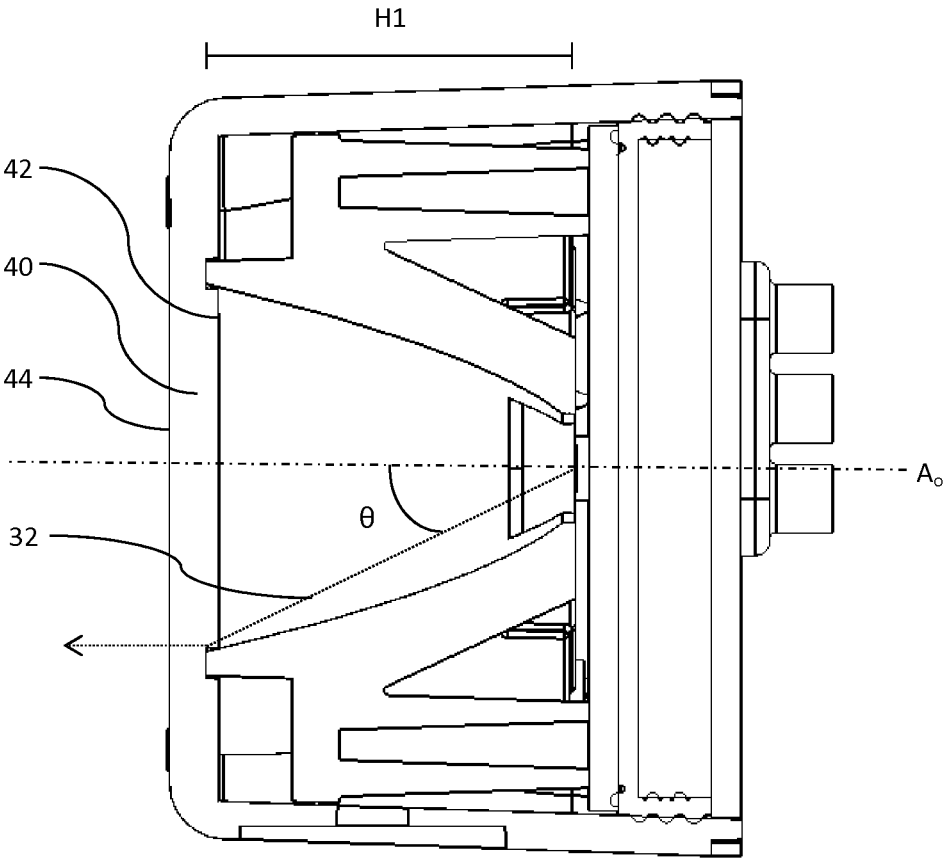
FIG. 8 is a side sectional view of the lens of FIG. 6 taken along line C-C thereof.

In the embodiment depicted in FIGS. 6-8, a collimating lens 40 refracts a portion of the light within θ degrees from optical axis $A_o$. Referring to FIG. 8, light entry surface 42 and light emission surface 44 of lens 40 cooperate to refract the "narrow angle" light divergent from optical axis $A_o$ into a direction substantially parallel to optical axis $A_o$. In one embodiment, the diameter of lens 40 is dependent on θ and H1, and is designed to capture and refract a majority of the light not handled by the inner reflecting surface 10. In one embodiment, the lens 40 redirects light divergent from longitudinal axis $A_L$ into a direction substantially parallel with the longitudinal axis $A_L$. This creates a wide-angle beam of light that is focused about the longitudinal axis $A_L$.

What is claimed:

1. A reflector for use in conjunction with an LED light source having an optical axis $A_o$ centered on an area of light emission from which light is emitted in a hemispherical emission pattern surrounding said optical axis $A_o$, said light is emitted to one side of a first plane $P_1$ coincident with said LED light source and perpendicular to said optical axis $A_o$, said reflector comprising:

an inner reflecting surface and an interrupted outer reflecting surface, said inner reflecting surface defined by a portion of a parabola having a focus at said LED light source rotated about said optical axis $A_o$, said inner reflecting surface originating at said first plane $P_1$ to an outer end and defining a pair of windows arranged opposite one another along a longitudinal axis $A_L$, each of said pair of windows having an upper edge spaced apart from said first plane and extending about said optical axis $A_L$ over a first arc centered on said longitudinal axis $A_L$, said interrupted outer reflecting surface defined by a portion of a parabola having a focus at said LED light source rotated about said optical axis $A_o$, said interrupted outer reflecting surface extending from a first end spaced from said first plane to a second end, said outer reflecting surface consisting of a pair of arcuate segments centered on said longitudinal axis $A_L$;

wherein each of said pair of windows are configured to allow light from said LED light source to pass said inner reflecting surface to reflect on one of said arcuate segments of said outer reflecting surface, and wherein said inner reflecting surface and said outer reflecting surface arcuate segments redirect light rays divergent from said optical axis $A_o$ into a direction substantially parallel with said optical axis $A_o$.

2. The reflector of claim 1, wherein the outer reflecting surface is interrupted by a plurality of supporting members arranged opposite one another about said longitudinal axis $A_L$, said supporting members extending between said arcuate segments projecting towards said longitudinal axis $A_L$ to fix said inner reflecting surface relative to said outer reflecting surface, and said inner reflecting surface is a continuous surface of revolution from said upper edge of said pair of windows to said outer end.

3. The reflector of claim 1, wherein said first plane $P_1$ is axially closer to said second end than said outer end.

4. An optical assembly for use in conjunction with an LED light source having an optical axis $A_o$ centered on an area of light emission from which light is emitted in a hemispherical emission pattern surrounding said optical axis $A_o$, said light is emitted to one side of a first plane $P_1$ coincident with said LED light source and perpendicular to said optical axis $A_o$, said reflector comprising:

an inner reflecting surface and an outer reflecting surface, said inner reflecting surface defined by a curve of a parabola having a focus at said LED light source rotated about said optical axis $A_o$ extending from an inner end at said first plane $P_1$ to an outer end and having a plurality of windows arranged opposite one another along a longitudinal axis $A_L$, said windows extending from said first plane $P_1$ to a height spaced from said first plane $P_1$, said inner reflecting surface being an uninterrupted surface of rotation from said height to said outer end, and said outer reflecting surface comprising a pair of arcuate segments centered on said longitudinal axis $A_L$ and separated by supporting members, said windows and said arcuate segments each having an arcuate extent defined between said supporting members, each arcuate segment defined by a curve of a parabola having a focus at said LED light source rotated about said optical axis $A_o$, each said segment extending from a first end spaced a first distance from said first plane $P_1$ to a second end at a second distance from said first plane $P_1$, said second distance being greater than said first distance and less than a height of said inner reflecting surface; and a lens centered on said optical axis $A_o$ and defined by a light entry surface and a light emission surface;

wherein said windows are configured to allow light to reflect on said outer reflecting surface, and wherein said light entry surface, said inner reflecting surface, and said outer reflecting surfaces are configured to cooperate to redirect light rays divergent from said optical axis $A_o$ into a direction substantially parallel with said optical axis $A_o$.

5. The optical assembly of claim 4, wherein the outer reflecting surface is interrupted by said supporting members, said supporting members are arranged opposite one another about said longitudinal axis $A_L$, and said supporting members extending between said arcuate segments projecting towards said longitudinal axis $A_L$ to fix said inner reflector relative to said outer reflector.

6. A reflector for use in conjunction with an LED light source having an optical axis $A_o$ centered on an area of light emission from which light is emitted in a hemispherical emission pattern surrounding said optical axis $A_o$, said light is emitted to one side of a first plane $P_1$ coincident with said LED light source and perpendicular to said optical axis $A_o$, said reflector comprising:

an inner reflecting surface and an outer reflecting surface arranged along a longitudinal axis $A_L$, said inner reflecting surface defined by a curve rotated about said optical axis $A_o$, said inner reflecting surface extending from said first plane $P_1$ to an outer end and defining a pair of windows arranged opposite one another and centered on the longitudinal axis $A_L$, said windows extending between radially oriented edges of a pair of supporting members, said radially oriented edges oriented at an angle $\alpha$ relative to the longitudinal axis $A_L$, and said outer reflecting surface defined by a curve rotated about said optical axis $A_o$, said outer reflecting surface comprising a pair of arcuate segments interrupted by said supporting members, said arcuate segments centered on the longitudinal axis $A_L$ and extending between ends defined by said supporting members at an angle $\beta$ relative to the longitudinal axis $A_L$, said supporting members occupying a space between the arcuate segments, said outer reflecting surface extending along optical axis $A_o$ from a first end to a second end;

wherein said inner and outer reflecting surfaces consist essentially of coaxial surfaces of revolution, said angle $\beta$ is greater than said angle $\alpha$, said windows are configured to allow light to pass said inner reflecting surface and be reflected by said outer reflecting surface, and wherein said inner reflecting surface and said outer reflecting surfaces are configured to cooperate to redirect light rays divergent from said optical axis $A_o$ into a direction substantially parallel with said optical axis $A_o$.

7. The reflector of claim 6, wherein said first plane $P_1$ is axially closer to said second end than said outer end.

8. The reflector of claim 6, wherein said inner reflecting surface is defined by a curve of a parabola having a focus at said LED light source.

9. The reflector of claim 6, wherein said outer reflecting surface is defined by a curve of a parabola having a focus at said LED light source.

10. The reflector of claim 6, wherein a height of said windows is defined by an angle $\delta$ relative to said optical axis $A_o$ and said angle $\delta$ is greater than said angle $\alpha$.

11. The reflector of claim 6, wherein an arcuate opening of said windows is shorter than an arcuate extent of said outer reflecting surface.

12. The reflector of claim 6, wherein an arcuate opening of said windows is shorter than an arcuate extent of said supporting members.

13. The reflector of claim 6, wherein the outer reflecting surface is interrupted by said supporting members, said supporting members are arranged opposite one another perpendicular to said optical axis $A_o$, and said supporting members extending between said arcuate segments projecting towards said longitudinal axis $A_L$ to fix said inner reflector relative to said outer reflector.

14. The reflector of claim 6, wherein each window has side edges parallel with a radius of each window and an upper edge parallel with the first plane $P_1$.

15. The reflector of claim 6, wherein the light emitted by said LED light source is not incident upon said pair of supporting members.

* * * * *